US005165210A

United States Patent [19]

Partyka et al.

[11] Patent Number: 5,165,210

[45] Date of Patent: Nov. 24, 1992

[54] METHOD OF FORMING A ROOF SEAL

[75] Inventors: Donald F. Partyka, Heath, Ohio; Stephen A. Gendron, Albuquerque, N. Mex.

[73] Assignee: Insta-Foam Products, Inc., Joliet, Ill.

[21] Appl. No.: 649,656

[22] Filed: Feb. 1, 1991

[51] Int. Cl.[5] ..... B04B 5/00

[52] U.S. Cl. ..... 52/746; 52/408; 52/410; 156/71

[58] Field of Search ..... 52/746, 747, 741, 408, 52/309.12, 309.13, 410, 309.9; 156/71

[56] References Cited

U.S. PATENT DOCUMENTS

| | | | |
|---|---|---|---|
| 3,094,447 | 6/1963 | Chamberlain | 52/746 |
| 3,646,715 | 3/1972 | Pope | 52/809.9 |
| 3,694,306 | 9/1972 | Fricklas | 52/408 |
| 3,763,605 | 10/1973 | Freeman | 52/408 |
| 4,190,989 | 3/1980 | Sakharoff | 52/741 |
| 4,509,999 | 4/1985 | Sandor | 156/71 |
| 4,707,961 | 11/1987 | Nunley et al. | 52/741 |

FOREIGN PATENT DOCUMENTS

| | | | |
|---|---|---|---|
| 2756621 | 6/1979 | Fed. Rep. of Germany | 156/71 |
| 3043846 | 7/1982 | Fed. Rep. of Germany | 156/71 |

OTHER PUBLICATIONS

*Handi-Foam II Night Guard* Brochure, published Feb. 1988 by Universal Foam Systems, Inc., Cudahy, Wis.

*Primary Examiner*—David A. Scherbel
*Assistant Examiner*—Winnie Yip
*Attorney, Agent, or Firm*—Lockwood Alex Fitzgibbon & Cummings

[57] ABSTRACT

A method for forming a temporary seal between a roof substrate and a flexible membrane is disclosed. At the end of a work day, the roofing membrane is folded upon itself along a foldline to define a leading edge of the membrane. An expandable polyurethane foam is injected into the interface formed between the membrane leading edge and the roof substrate. The foam is allowed to expand into a wedge shape and adhere to the membrane leading edge and roof substrate. After it cures, the foam wedge is substantially impervious to water and moisture migration. When work is resumed, the membrane is peeled away from the formed wedge, preferably at an angle, and the existing roof substrate is removed.

13 Claims, 1 Drawing Sheet

METHOD OF FORMING A ROOF SEAL

BACKGROUND AND SUMMARY OF THE PRESENT INVENTION

The present invention relates generally to roofing seals and, more particularly, to an improved method for temporarily sealing a roofing membrane to a roof substrate. The present invention finds particular utility in the field of replacement of roofing, or reroofing.

When an existing roof is replaced on a structure, one or more elastomeric, flexible membranes are commonly used as the top layer of the new roof to provide a watertight and weatherproof barrier for the top surface of a roof. The existing roof typically includes a lower base or support member, such as corrugated steel decking, and one or more layers of insulation which cover the base. These layer(s) of insulation are covered with a waterproof layer which may include one or more layers of roofing felt embedded in either hot tar or asphalt to form a substantially water-impervious coating. Loose gravel may be scattered across the top of this layer to improve its resistance to abrasion and ultraviolet radiation. Through repeated exposure to weather, the impervious asphalt-gravel layer may break down and water may permeate through the various roof layers, causing leakage. The old roof layers are removed and new insulation is applied to the decking along with a new top waterproof layer which includes one or more waterproof, elastomeric membranes. These membranes are sealed in various manners to the insulation layers beneath them to form an impervious top roof layer. The roofing membrane is applied to the roof in an area which is only large enough to be completed during the working hours.

When the roof area is large enough that the entire extent of the new insulation layers cannot be installed and covered with a membrane within the working hours of a single day, the flexible roofing membrane must be secured to the roof in a manner to prevent the wind from lifting it up along an open edge, as well as to prevent the infiltration or migration of water underneath the membrane. To prevent this from occurring, the membrane must be temporarily sealed to the roof substrate along its leading edge.

One practice presently followed in the art involves sealing the membrane to the roof with an expandable foam which is substantially impervious to water. This practice requires that a first layer of the foam having a preselected width be applied to the roof substrate. The leading edge of the roofing membrane is carefully embedded into the first foam layer, and a second layer of foam is subsequently applied to the top of the roofing membrane along its leading edge and also to a portion of the first foam layer to create an overlapping foam seal which is impervious to moisture. When work is resumed, the leading edge of the membrane sealed to the first and second foam layers is cut off and discarded. This procedure not only wastes material because the membrane is cut, but also is time intensive because it requires the application of two layers of foam. Additionally, the membrane is adhered to the first foam layer for approximately only one-half of the width of that first foam layer.

Another practice commonly used in the art involves sealing the membrane to the roof with a layer of plastic cement or hot asphalt. This practice is also labor-intensive and also wastes material in that the membrane must be cut away from the adhesive layer.

The present invention is therefore directed to a method which overcomes these disadvantages and accordingly concerns itself with the establishment of a temporary, or night seal between the roofing membrane, and the existing roof substrate in which the membrane may be easily removed from the roof substrate and in which the membrane does not have to be cut to remove the temporary seal. This method thus reduces the amount of time required to remove the temporary seal and resume work as well as saves on materials.

Such a temporary seal is accomplished by folding the roof membrane onto itself along a preselected foldline to define a leading edge of the membrane and applying a layer of foam adjacent the membrane leading edge such that the foam adheres to both the roof substrate and the underside of the membrane. The foam is allowed to expand upwardly against the membrane and outwardly from its leading edge to form an impervious wedge-shaped foam layer. The membrane can be easily peeled away from the membrane to remove it from the foam and the installation of the replacement roof and membrane resumed.

Accordingly, it is an object of the present invention to provide a method for applying a temporary, or night seal to a roofing membrane in which the membrane is folded over upon itself and an impervious layer of an expandable foam is formed at the leading edge of the membrane and the roof substrate which seals the interface of the membrane and the roof substrate from water or inclement weather.

It is another object of the present invention to provide a method for temporarily sealing a roofing membrane to the roof substrate in which the membrane is not cut.

It is a further object of the present invention to provide a method for applying a flexible, elastomeric membrane to a roof substrate in which the flexible membrane is unrolled onto and adhered to a portion of the roof substrate, the leading edge of the membrane is folded upon itself along a foldline extending between two opposing edges of the roof, and a sealing member in the form of an expandable foam is laid down proximate to the exposed leading edge of the membrane, the sealing member extending between the roof substrate and the underside of the membrane, the foam being allowed to expand into a substantially impervious wedge and to adheringly contact the roof substrate and the membrane, and the membrane being peeled away from the foam wedge when work is to resume on the roof.

These and other objects of the present invention will become more readily apparent from a reading of the following detailed description taken in conjunction with the accompanying drawings wherein like reference numerals refer to like parts.

BRIEF DESCRIPTION OF THE DRAWINGS

In the course of this description, reference will be made to the attached drawings in which.

DETAILED DESCRIPTION OF THE PREFERRED EMBODIMENTS

Figure 1:
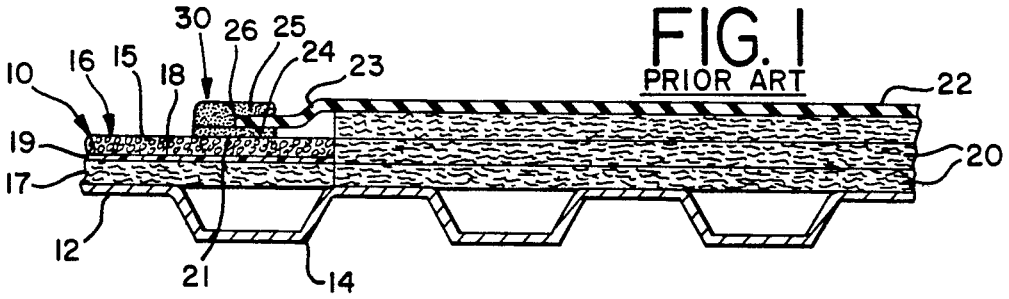
FIG. 1 PRIOR ART
FIG. 1 illustrates a sectional view of a temporary roof seal typical of the prior art.

FIG. 1 illustrates a cross-section of a roof seal which is representative of the methods presently used in the reroofing art to apply temporary roof seals. The roof 10 has a base or support member 12, shown as a section of corrugated steel decking 14, which typically spans the width between opposing edges (not shown) of the structure to provide structural support to the roof 10. An existing roof substrate 16 overlies the roof decking 14 and may include typical components such as one or more layers of rigid insulation 17, and a waterproof top layer 18 formed from one or more layers of roofing felt 19 embedded in a hot tar or asphalt and gravel mixture 15. This roof construction is commonly referred to as a "built-up roof". When a built-up roof is replaced, a portion of the existing roof substrate 16 is removed and one or more new layers of rigid board insulation 20 are laid over the exposed decking 14. The new insulation 20 is then covered with a flexible, elastomeric membrane 22. When the roof repair work ends for the day the flexible membrane is temporarily sealed to the roof to prevent the infiltration and/or migration of water under the membrane.

The temporary seal includes a first layer 24 of foam which is applied to the surface of the roof substrate top layer 18 in the form of a wide strip 21 into which the leading edge 26 of the membrane 22 is embedded. A second layer 25 of foam is applied over the first foam layer 24 to cover the exposed portion of the strip 19 and to cover a preselected width of the membrane leading edge 26 to create a seal 30 (approximately 3 inches wide) which adheres the membrane 22 to the existing roof substrate 16. The application of this type of seal 30 is labor-intensive because it requires two foam layers 24, 25 to be laid on the existing substrate 16 and because it requires that the membrane 22 be positively embedded in the foam 24.

The removal of such a temporary seals 30, requires that the roofer first cut the membrane 22 along a line 23 selected well behind the foam layers 24, 25 and secondly discard the membrane leading edge 26. The old roof substrate 16 is then removed and the reroofing task continued such as placement of new insulation 20 and the flexible membrane 22. When this type of seal 30 is applied, care must be taken to ensure that the entire leading edge 26 of the membrane 22 is adhered to the first and second foam layers 24, 25 so that no openings are created between the foam layers 24, 25 and the roof substrate which will permit the entry of water or migration of moisture under the membrane 22 and into the newly placed insulating layers. In addition, if the leading edge is not completely sealed wind may enter underneath the membrane 22, it may lift the membrane 22 up and cause it to flutter and possibly rip, necessitating replacement of the membrane 22. When the membrane 22 is repeatedly cut, material is wasted.

The present invention eliminates the need to cut the membrane and apply further reduces the application labor at least in half by dispensing with the need to apply two separate layers of foam. In accordance with a method of the present invention, the roofer folds the membrane upon itself and adheres the membrane leading edge so formed to the roof substrate at the interface of the membrane and substrate.

Figure 2:
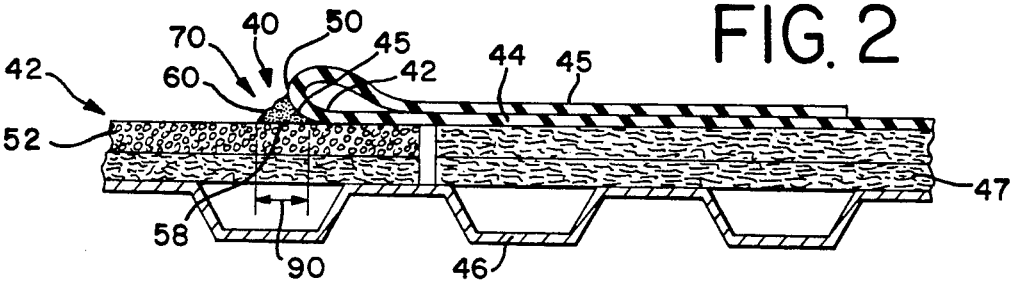
FIG. 2 is a sectional view of a temporary roof seal formed in accordance with the principles of the present invention.

FIG. 2 illustrates a temporary, or night, seal 40 constructed in accordance with the present invention which has been applied to a roof 42 to retain a flexible, waterproofing membrane 44 thereto on a temporary basis. The construction of the roof substrate 52 is generally the same in that the replacement roof 42 includes a lower support layer of corrugated steel decking 46, one or more layers of rigid insulation 47 disposed over the decking 46, and one or more flexible, elastomeric membranes 45 which cover the flexible membrane 44.

To form the temporary seal 40, the membrane 44 is folded upon itself along a predesignated foldline 50 disposed above the existing roof substrate 52, that is, ahead of the newly added insulation layer(s) 47 such that a sufficiently wide portion, or flap, 45 of the membrane lies upon itself. A leading edge 56 of the membrane is thereby defined at the interface 58 between the membrane 44 and the existing roof substrate 52. An expanding polyurethane foam bead 60 is then applied generally parallel to the foldline 50 and leading edge 56 between the membrane 44 and the roof substrate 52 at the leading edge 56 of the membrane 44.

Figure 3:
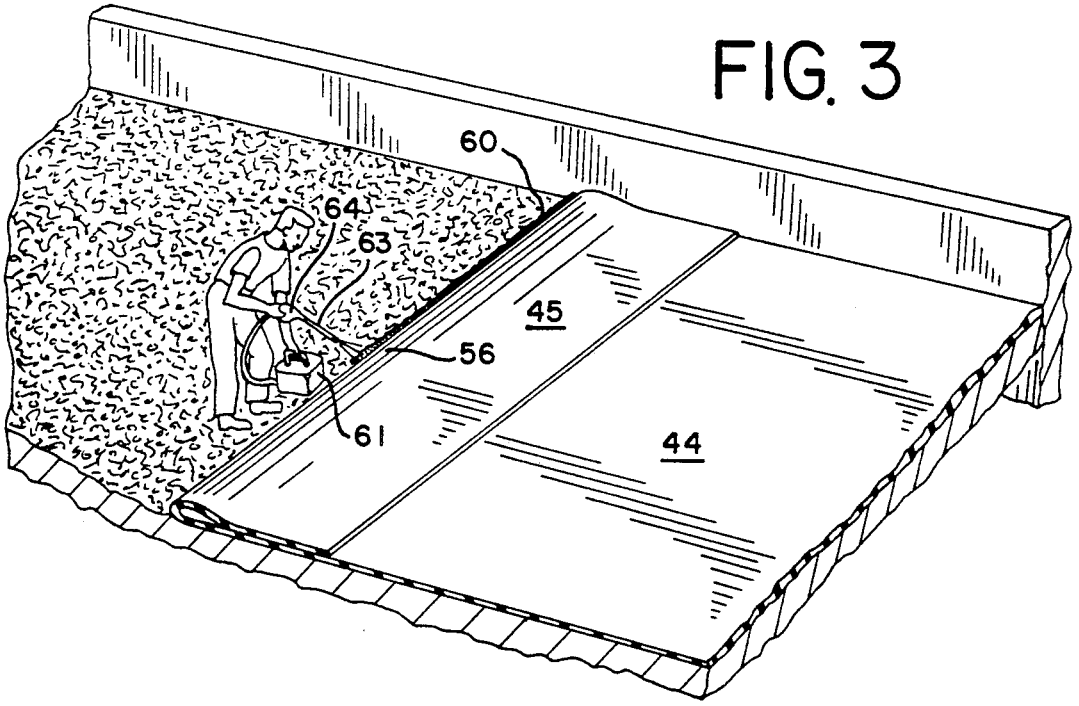
FIG. 3 is a perspective view of an application of the present invention.

Preferably, the foam bead 60 is dispensed from a self-contained, pressurized container 61, as illustrated in FIG. 3, in a single pass, with the nozzle 63 of the container 60 positioned to apply the foam bead 60 in the interface 58. The polyurethane foam 60 used may be one typically available in the art, such as the FROTH-PAK TM foam manufactured and sold by Insta-Foam Products, Inc. of Joliet, Ill. Such urethane foams are advantageous for use in the present invention because they are formed by the reaction between two separate components released simultaneously from pressurized containers and mixed together in a mixing chamber 64 which precedes the application nozzle 63. Such urethane foams are generally formed from an isocyanate and a hydroxylrich resin. Typically, the isocyanate is a polymeric isocyanate and the resin is a polyether or a polyester. One or both components may also contain additives and a catalyst or blowing agent required to expand and cure the foam.

Figure 4:
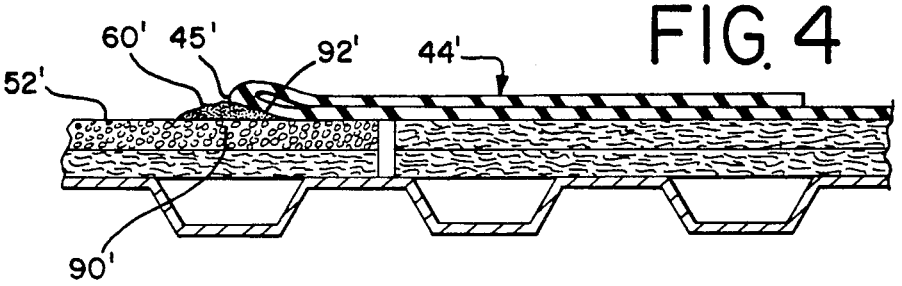
FIG. 4 is a sectional view of a second embodiment of a temporary roof seal formed in accordance with the principles of the present invention.

The foam bead 60 is preferably applied in such a manner that it forms a wedge 70 (FIG. 2) which allows the foam 60 to expand upwardly against the underside 45 of the membrane 44 along the entire leading edge 56 thereof. The foam 60, because of its natural expensive properties, also expands outwardly to fill any voids between the existing roof substrate 52 and the overlying flexible membrane 44. Because the polyurethane foam 60 has a closed cell structure upon curing, the wedge 70 provides a barrier or dam which is impervious to moisture and water migration. It will be understood that foam bead shapes other than wedges will suffice as shown in FIG. 4, provided that the foam bead 60' maintains two sealing surfaces 90', 92' against respective opposing surfaces of the roof substrate 52' and the membrane underside 45' to develop the required seal for the membrane 44'.

Preferably, the foam bead 60 is further applied in a manner such that it develops two sealing surfaces 90, 92 which oppose the roof substrate 52 and membrane underside 45, respectively. These sealing surfaces 90, 92 may be between approximately 2 and 3 inches wide with preferred results being obtained with widths of approximately 2½ inches wide. Thus, the total contact, or sealing, surface between the foam wedge 70 and the roof substrate 52 and membrane 44 which it contacts totals approximately 5 inches. This total sealing surface is more than three times the contact surface of the temporary seal 40 shown in FIG. 1. With this method of application, the need (as well as time and labor) for application of two foam layers is eliminated. Additionally, the injection of the foam bead 60 into the interface 58 between the membrane 44 and the roof substrate 52 ensures the proper desired seal in that it eliminates the time and need to positively embed the membrane 44 in the foam wedge 70.

The removal of the night seal 40 is also time and material efficient in that at the start of the next working day, the roofer can grab an edge of membrane portion 54 and peel it away from the wedge 70 at an angle. When the entire leading edge 56 of the membrane 44 is freed from the foam wedge 70, the existing roof substrate 52 containing the foam 70 may be removed.

It will be appreciated that the embodiments of the present invention that have been discussed herein are merely illustrative of a few applications of the principles of the invention. Numerous modifications may be made by those skilled in the art without departing from the true spirit and scope of the invention.

We claim:

1. A method for forming a temporary seal between an elongated elastomeric roofing membrane and an existing roof substrate, comprising the steps of:

defining a foldline in the roofing membrane proximate to a intended point of sealing said roofing membrane to the existing roofing substrate such that the foldline is disposed over the existing roof substrate;

folding said roofing membrane backwardly upon itself along said membrane foldline to expose an underside surface of said roofing membrane and to thereby form a membrane flap disposed proximate to said intended sealing point, the membrane flap having an exposed underside surface which extends away from a membrane leading edge, said membrane flap exposed underside surface further defining said leading edge of said roofing membrane;

applying an expandable polyurethane foam to an interface of said roof substrate and said roofing membrane leading edge;

allowing said polyurethane foam to expand between said roofing membrane leading edge and a portion of said existing roof substrate, thereby forming a sealing element having distinct first and second sealing surfaces, and allowing said polyurethane foam to cure such that the sealing element formed thereby is substantially impervious.

2. The method of claim i, further including the step of removing substantially all loose material from said existing roof substrate directly ahead of and adjacent to said roofing membrane leading edge.

3. The method of claim 1, wherein said expandable foam sealing element is wedge-shaped.

4. The method of claim 1, wherein said expandable polyurethane foam is applied to said roof substrate in the form of a wide bead.

5. The method of claim 1, wherein said expandable polyurethane foam is formed from a mixture of a polymeric isocyanate and a polyether resin.

6. The method of claim 1, wherein said polyurethane foam sealing element contacts a portion of said existing roof substrate which is between 2 and 3 inches wide and further contacts said roofing membrane leading edge along said roofing membrane underside surface for a distance of approximately between 2 and 3 inches.

7. The method of claim 1, wherein said polyurethane foam is applied to said existing roof substrate in a strip which extends the entire length of said roofing membrane leading edge, the strip having a width of approximately between 2 and 3 inches.

8. The method of claim 1, wherein said leading edge of said roofing membrane is generally parallel to said membrane foldline.

9. A method of applying a flexible roofing membrane to a replacement roof which includes forming a temporary seal between the roofing membrane to an existing roof substrate at the end of the work day or at the onset of inclement weather, the method comprising the steps of:

removing a portion of said existing roof substrate in a predesignated work area;

applying at least one new insulation layer to a roof support means in the predesignated work area;

covering said at least one new insulation layer with an elongated, flexible elastomeric roofing membrane;

defining a foldline in said roofing membrane outwardly of said predesignated work area and above said existing roof substrate;

folding said roofing membrane backwardly upon itself along said foldline to expose an underside surface of said roofing membrane in the form of a roofing membrane flap and to define a leading edge of said roofing membrane which is generally parallel to said membrane foldline, the roofing membrane flap extending rearwardly away from said membrane lading edge, said membrane leading edge being disposed generally over and in contact with said existing roof substrate;

injecting, when work on said roof is to be ended, an expandable polyurethane foam under said roofing membrane along a line generally parallel to said membrane foldline and proximate to said membrane foldline so as to form a foam bead which expands into a seal element having a first sealing surface which adheres to said existing roof substrate and a second sealing surface which adheres to said roofing membrane;

allowing said injected foam to cure into a substantially impervious closed cell structure; and removing, at the resumption of work, said roofing membrane from contact with said sealing element by pulling said membrane flap such that said roofing membrane no longer contacts said foam sealing element.

10. The method of claim 9, further including the step of pulling said membrane flap at an angle with respect to said membrane leading edge.

11. The method of claim 9, wherein each of said sealing element first and second sealing surfaces have a width which is between approximately 2 and 3 inches wide.

12. The method of claim 9, wherein said sealing element is wedge-shaped.

13. A method of forming a temporary, overnight roof seal between a flexible, elastomeric roofing membrane comprising the steps of:

removing a portion of said existing roof substrate in a predesignated work area;

covering said predesignated work area with an elongated, flexible elastomeric roofing membrane;

defining a foldline in said roofing membrane outwardly of said predesignated work area and above said existing roof substrate;

folding said roofing membrane backwardly upon itself along said foldline to expose an underside surface of said roofing membrane, the exposed roofing membrane forming a roofing membrane flap, said roofing membrane foldline further defining a leading edge of said roofing membrane which is generally parallel to said membrane foldline, the roofing membrane flap extending rearwardly away from said membrane lading edge, said membrane leading edge being disposed generally over and in contact with said existing roof substrate;

injecting an expandable polyurethane foam between said roofing membrane leading edge and said roof substrate along a line generally parallel and proximate to said membrane foldline so as to form a foam bead having a first sealing surface approximately 2 to 3 inches wide which adheres to said existing roof substrate and a second sealing surface approximately 2 to 3 inches wide which adheres to said roofing membrane along said leading edge thereof; and allowing said injected foam to cure into a substantially impervious closed cell structure.

* * * * *